US008579014B2

(12) United States Patent
Kauppila et al.

(10) Patent No.: US 8,579,014 B2
(45) Date of Patent: Nov. 12, 2013

(54) COOLING ARRANGEMENT FOR CONVEYORS AND OTHER APPLICATIONS

(76) Inventors: Richard W. Kauppila, Negaunee, MI (US); Raymond W. Kauppila, Marquette, MI (US)

( * ) Notice: Subject to any disclaimer, the term of this patent is extended or adjusted under 35 U.S.C. 154(b) by 671 days.

(21) Appl. No.: 12/583,328

(22) Filed: Aug. 18, 2009

(65) Prior Publication Data

US 2010/0059205 A1 Mar. 11, 2010

Related U.S. Application Data

(60) Division of application No. 11/140,694, filed on May 31, 2005, now Pat. No. 7,575,043, which is a continuation-in-part of application No. 10/134,993, filed on Apr. 29, 2002, now abandoned.

(60) Provisional application No. 60/586,685, filed on Jul. 9, 2004.

(51) Int. Cl.

| | |
|---|---|
| ***F24H 3/00*** | (2006.01) |
| ***F28D 15/00*** | (2006.01) |
| ***F28D 13/00*** | (2006.01) |

(52) U.S. Cl.

USPC ..... 165/47; 165/104.13; 165/104.15; 165/104.16; 432/1; 432/14; 432/15

(58) Field of Classification Search

USPC ..... 165/104.15, 104.16, 104.17, 104.18, 165/104.19, 104.13; 432/1, 4, 14, 15, 17, 432/18, 27, 30, 77, 83, 86, 112, 116, 233

See application file for complete search history.

(56) References Cited

U.S. PATENT DOCUMENTS

| | | | | | |
|---|---|---|---|---|---|
| 360,971 | A | | 4/1887 | Palmer et al. | |
| 608,755 | A | * | 8/1898 | Cottle | 126/620 |
| 965,391 | A | * | 7/1910 | Little | 126/620 |
| 1,698,313 | A | | 1/1929 | Luther | |
| 1,716,333 | A | * | 6/1929 | Vuilleumier | 165/185 |
| 1,792,769 | A | | 2/1931 | Schmidt | |
| 1,953,342 | A | * | 4/1934 | Foell | 165/9.2 |
| 2,036,068 | A | * | 3/1936 | Montsinger | 336/94 |
| 2,401,797 | A | * | 6/1946 | Rasmussen | 29/890.03 |
| 2,431,455 | A | * | 11/1947 | Blanding | 261/94 |
| 2,525,261 | A | * | 10/1950 | Henderson | 221/150 R |

(Continued)

FOREIGN PATENT DOCUMENTS

| | | |
|---|---|---|
| GB | 264670 | 1/1927 |
| GB | 825075 | 12/1959 |
| JP | 404369389 | 12/1992 |

*Primary Examiner* — Ljiljana Ciric
(74) *Attorney, Agent, or Firm* — John R. Benefiel

(57) ABSTRACT

A conveyor for moving hot material at temperatures on this order of 1000° F. or higher along a conveyor trough receiving the material has one or more coolant liquid flow vessels extending over but spaced from the outer surface of a trough inner wall to indirectly cause cooling of the inner wall. A heat transfer path is established between a separate coolant flow vessel and the hot trough defined by a packed together mass of heat conductive beads interposed to controllably transfer heat into the coolant liquid flowing through the flow vessel to prevent boiling of the coolant while allowing heat to be transferred from the through into the coolant in the separate flow vessel. The arrangement of a mass of heat conductive beads is also used to provide a non rigid mechanical support of fluid carrying tubing, the support having a predetermined thermal conductivity.

8 Claims, 6 Drawing Sheets

(56) References Cited

U.S. PATENT DOCUMENTS 2,616,668 A * 11/1952 Gerhart et al. ..... 165/10
2,898,091 A * 8/1959 Verbeek ..... 165/10
2,908,486 A 10/1959 Thornburg
3,049,799 A * 8/1962 Breining et al. ..... 419/61
3,094,397 A 6/1963 Lopker
3,135,044 A * 6/1964 Mote, Jr. et al. ..... 29/898.069
3,144,905 A 8/1964 Albert
3,153,279 A * 10/1964 Chessin ..... 428/567
3,161,478 A * 12/1964 Chessin ..... 428/613
3,235,972 A * 2/1966 Hood et al. ..... 165/104.16
3,289,756 A * 12/1966 Jaeger ..... 29/890.036
3,295,591 A * 1/1967 Thomason ..... 126/400
3,306,353 A * 2/1967 Burne ..... 165/164
3,331,435 A * 7/1967 Valyi ..... 165/135
3,369,541 A * 2/1968 Thomason ..... 126/620
3,384,557 A * 5/1968 Saller ..... 165/104.16
3,513,908 A * 5/1970 Singh ..... 165/164
3,580,389 A 5/1971 Nonnenmacher
3,587,730 A * 6/1971 Milton ..... 65/133
3,596,713 A * 8/1971 Katz ..... 165/104.17
3,607,086 A 9/1971 Dingus
3,621,905 A * 11/1971 Hedstrom ..... 165/104.16
3,627,036 A 12/1971 Gilbert
3,637,069 A 1/1972 Christian et al.
3,645,237 A * 2/1972 Seth ..... 165/104.16
3,666,006 A * 5/1972 Valyi ..... 165/164
3,670,276 A * 6/1972 Theodore ..... 336/92
3,698,541 A 10/1972 Barr
3,704,748 A * 12/1972 Hapgood ..... 165/165
3,732,919 A * 5/1973 Wilson ..... 165/166
3,753,757 A * 8/1973 Rodgers et al. ..... 427/183
3,762,026 A * 10/1973 Shapiro ..... 29/530
3,773,031 A * 11/1973 Laing et al. ..... 126/400
3,775,041 A * 11/1973 Buttner ..... 165/104.34
3,802,551 A 4/1974 Somers
3,808,988 A 5/1974 Sugano et al.
3,821,018 A * 6/1974 Grant ..... 427/377
3,822,651 A 7/1974 Harris et al.
3,884,772 A * 5/1975 Shiga ..... 205/109
3,885,529 A * 5/1975 Renzi ..... 165/165
3,887,672 A * 6/1975 Stahnecker et al. ..... 264/51
3,894,685 A * 7/1975 Keyes et al. ..... 126/620
3,921,712 A * 11/1975 Renzi ..... 165/165
3,960,203 A * 6/1976 Dunn, Jr. ..... 165/104.16
3,973,718 A * 8/1976 Deschamps ..... 29/890.03
3,981,151 A * 9/1976 St. Clair ..... 126/620
3,990,862 A * 11/1976 Dahl et al. ..... 165/133
3,995,181 A * 11/1976 Suit ..... 165/104.19
3,998,188 A 12/1976 Priest et al.
4,050,897 A 9/1977 Klein
4,051,891 A * 10/1977 Harrison ..... 126/620
4,063,589 A * 12/1977 Battcock ..... 165/104.16
4,078,392 A * 3/1978 Kestner ..... 165/104.13
4,104,883 A * 8/1978 Naef ..... 165/104.13
4,109,702 A * 8/1978 Greene ..... 165/104.13
4,124,357 A * 11/1978 Akimoto et al. ..... 422/181
4,126,177 A 11/1978 Smith et al.
4,127,973 A * 12/1978 Kachadorian ..... 126/620
4,129,181 A * 12/1978 Janowski et al. ..... 165/133
4,142,576 A * 3/1979 Perry et al. ..... 165/104.14
4,180,718 A 12/1979 Hanson
4,182,412 A * 1/1980 Shum ..... 165/133
4,187,831 A * 2/1980 Eubank ..... 165/164
4,205,656 A * 6/1980 Scarlata ..... 165/133
4,207,943 A 6/1980 Gardner et al.
4,219,075 A * 8/1980 Laing ..... 165/104.13
4,227,567 A * 10/1980 Greene ..... 165/104.17
4,257,478 A * 3/1981 Stendahl ..... 165/104.16
4,258,783 A * 3/1981 Albertson et al. ..... 165/133
4,260,371 A 4/1981 O'ffill
4,262,485 A * 4/1981 Kuroda et al. ..... 165/104.13
4,273,101 A * 6/1981 Merges ..... 165/104.13
4,286,650 A * 9/1981 Lindner ..... 165/104.13
4,291,758 A * 9/1981 Fujii et al. ..... 165/133
4,323,113 A * 4/1982 Troyer ..... 165/45
4,335,785 A * 6/1982 Hodges et al. ..... 165/104.16
4,343,352 A * 8/1982 Bockman et al. ..... 165/104.16
4,355,627 A * 10/1982 Scarlata ..... 126/613
4,359,086 A * 11/1982 Sanborn et al. ..... 165/133
4,360,339 A * 11/1982 Blaskowski ..... 165/104.16
4,361,182 A * 11/1982 Michalak ..... 165/104.16
4,367,589 A 1/1983 Hillinger
4,381,818 A * 5/1983 Sachar et al. ..... 165/133
4,384,463 A 5/1983 Rica et al.
4,405,010 A * 9/1983 Schwartz ..... 165/10
4,408,659 A * 10/1983 Hermanns et al. ..... 165/104.16
4,418,683 A * 12/1983 Friefeld et al. ..... 165/104.13
4,437,315 A 3/1984 Rica et al.
4,439,141 A * 3/1984 Deckebach ..... 432/14
4,446,916 A * 5/1984 Hayes ..... 165/104.17
4,458,748 A * 7/1984 Yamada et al. ..... 165/133
4,499,944 A * 2/1985 Komakine ..... 165/104.16
4,509,584 A * 4/1985 Michalak et al. ..... 165/104.16
4,515,205 A * 5/1985 Kuwata ..... 165/104.16
4,520,862 A * 6/1985 Helmbold ..... 165/10
4,522,252 A * 6/1985 Klaren ..... 165/104.16
4,531,146 A * 7/1985 Cutchaw ..... 257/713
4,537,632 A * 8/1985 Mosser ..... 106/14.12
4,544,020 A * 10/1985 Chrysostome et al. .. 165/104.16
4,544,028 A * 10/1985 Chase ..... 165/104.15
4,565,242 A * 1/1986 Yano et al. ..... 165/10
4,575,010 A * 3/1986 Zimmerman ..... 239/650
4,593,754 A * 6/1986 Holl ..... 165/161
4,600,052 A * 7/1986 Wood et al. ..... 165/165
4,612,978 A * 9/1986 Cutchaw ..... 165/104.33
4,640,339 A * 2/1987 Klaren ..... 165/104.16
4,657,067 A * 4/1987 Rapp et al. ..... 165/10
4,659,613 A * 4/1987 Mosser et al. ..... 428/215
4,663,243 A * 5/1987 Czikk et al. ..... 165/133
4,693,754 A * 9/1987 Kondis ..... 106/404
4,703,749 A * 11/1987 Morse ..... 126/620
4,708,198 A * 11/1987 Holl ..... 165/159
4,724,172 A * 2/1988 Mosser et al. ..... 428/469
4,730,665 A * 3/1988 Cutchaw ..... 165/185
4,759,404 A * 7/1988 Henson et al. ..... 165/104.13
4,768,579 A * 9/1988 Patry ..... 165/10
4,770,237 A * 9/1988 Morin et al. ..... 165/104.16
4,809,771 A * 3/1989 Kennel et al. ..... 165/10
4,823,863 A * 4/1989 Nakajima et al. ..... 165/80.4
4,846,676 A 7/1989 Mathis
4,865,122 A * 9/1989 Brown ..... 165/104.16
4,880,054 A * 11/1989 Yoshida et al. ..... 165/133
4,884,169 A * 11/1989 Cutchaw ..... 165/104.33
4,889,060 A 12/1989 Ettehadieh
4,890,669 A * 1/1990 Zohler ..... 165/133
4,938,409 A * 7/1990 Roberts ..... 228/178
4,955,942 A * 9/1990 Hemenway, Jr. ..... 165/104.16
4,981,172 A * 1/1991 Haerle ..... 165/133
4,992,245 A * 2/1991 Van Slooten et al. .... 165/104.16
5,000,252 A * 3/1991 Faghri ..... 165/10
5,060,719 A * 10/1991 Avidan et al. ..... 165/104.13
5,123,480 A * 6/1992 Dixit ..... 165/104.16
5,227,026 A 7/1993 Hogan
5,239,839 A * 8/1993 James ..... 165/10
5,277,245 A * 1/1994 Dutta et al. ..... 165/104.16
5,286,951 A * 2/1994 Jones ..... 165/104.16
5,323,294 A * 6/1994 Layton et al. ..... 165/185
5,323,843 A * 6/1994 Olszewski et al. ..... 165/10
5,441,097 A * 8/1995 Kanda et al. ..... 165/10
5,542,022 A * 7/1996 Zauderer ..... 165/104.16
5,651,191 A 7/1997 Walunas et al.
5,687,706 A * 11/1997 Goswami et al. ..... 165/104.17
5,814,392 A * 9/1998 You et al. ..... 428/209
5,853,045 A * 12/1998 Patry et al. ..... 165/10
5,863,197 A 1/1999 Boy et al.
5,960,863 A * 10/1999 Hua ..... 165/80.3
6,047,767 A 4/2000 Bodhaine et al.
6,105,659 A * 8/2000 Pocol et al. ..... 165/10
6,171,691 B1 * 1/2001 Nishibayashi ..... 428/325
6,263,958 B1 * 7/2001 Fleishman ..... 165/104.16
6,302,188 B1 * 10/2001 Ruhl et al. ..... 165/10
6,547,222 B2 * 4/2003 Blischak et al. ..... 261/94
6,638,062 B1 * 10/2003 Davidson ..... 432/118
6,698,501 B2 * 3/2004 Fleischman ..... 165/104.16

(56) References Cited

U.S. PATENT DOCUMENTS

| | | | | |
|---|---|---|---|---|
| 6,701,742 | B2 * | 3/2004 | Mack et al. | 62/430 |
| 6,772,823 | B2 * | 8/2004 | Hirano | 165/10 |
| 6,774,482 | B2 * | 8/2004 | Colgan et al. | 257/712 |
| 6,808,631 | B2 * | 10/2004 | Paloheimo | 210/615 |
| 6,810,945 | B1 * | 11/2004 | Boissevain | 165/45 |
| 6,877,549 | B2 * | 4/2005 | Hirano | 165/10 |
| 6,896,039 | B2 * | 5/2005 | Dussinger et al. | 165/104.26 |
| 7,124,809 | B2 * | 10/2006 | Rosenfeld et al. | 165/104.26 |
| 7,364,707 | B2 * | 4/2008 | Davis et al. | 261/108 |
| 7,575,043 | B2 * | 8/2009 | Kauppila et al. | 165/47 |
| 7,618,684 | B2 * | 11/2009 | Nesbitt | 427/470 |
| 7,690,419 | B2 * | 4/2010 | Thayer et al. | 165/80.4 |
| 7,849,922 | B2 * | 12/2010 | Vinegar et al. | 166/272.1 |
| 7,931,086 | B2 * | 4/2011 | Nguyen et al. | 166/57 |
| 7,950,453 | B2 * | 5/2011 | Farmayan et al. | 166/272.1 |
| 7,993,599 | B2 * | 8/2011 | Leveson | 422/198 |
| 8,191,618 | B2 * | 6/2012 | Gering et al. | 165/10 |
| 8,230,901 | B2 * | 7/2012 | Osawa | 165/104.15 |
| 2003/0019613 | A1 * | 1/2003 | Fleischman | 165/104.16 |
| 2004/0055738 | A1 * | 3/2004 | Kauppila et al. | 165/47 |
| 2004/0069455 | A1 * | 4/2004 | Lindemuth et al. | 165/104.15 |
| 2005/0252636 | A1 * | 11/2005 | Kauppila et al. | 165/47 |
| 2007/0035927 | A1 * | 2/2007 | Erturk et al. | 361/700 |

* cited by examiner

COOLING ARRANGEMENT FOR CONVEYORS AND OTHER APPLICATIONS

CROSS REFERENCE TO RELATED APPLICATION

This application is a divisional of U.S. Ser. No. 11/140,694 filed on May 31, 2005, which is a continuation-in-part of U.S. patent application Ser. No. 10/134,993 filed on Apr. 29, 2002 which claims the benefit of U.S. provisional application S.N. 60/586,685 filed on Jul. 9, 2004.

BACKGROUND OF THE INVENTION

This invention concerns methods and arrangements for liquid cooling of structures contacting very hot materials which prevent the development of excessively high temperatures in the structure which can cause mechanical failures due to thermal stress. In conventional liquid cooling, liquid coolant typically flows through vessels in contact with the structures and a loss of cooling capacity may occur if the liquid coolant flowing in coolant vessels associated with the structures boils. This is a particular problem in conveyors such as auger or re-circulating chain flight conveyors used to convey very hot crushed or granular material exceeding 1000 EF through troughs such as in cement plants, lime kilns, power plants, etc.

Conveyors for such very hot materials have in the past had short service lives and were prone to failure. This is because of the effect of the high temperatures reached by the conveyor components as a result of conduction of heat from the conveyed material into the structure and components. Such conveyors have sometimes incorporated liquid cooling jackets within the conveyor trough along which the hot material is conveyed as by an auger extending along the length of the trough. In the past, the trough and jacket have been constructed as a weldment, and since the liquid cooled liner is in direct contact with the hot material conveyed, the welds are severely stressed by gross thermal expansions and contractions.

The resulting expansion and contraction of the trough and coolant jacket leads to cracking, buckling, weld failures and similar structural failures. If very hot material is conveyed (1000 EF or higher), cooling liquid in direct contact with the cooling jacket wall is heated to boiling, so that vapor is generated in the jacket, greatly reducing the rate of heat conduction into the cooling liquid.

The high heat flux boiling that is encountered, usually has regions of unstable film boiling which causes a thermal shock in the structure surface, which in turn can cause plastic mechanical behavior. This can lead to premature failure and has been studied mathematically and experimentally. See Kappila, R. W., "A Boiler Tube Problem, Elastic-Plastic Behavior of a Thick-Walled Cylinder Caused By Sinusoidal Inside Surface Temperature, Internal Heat Generation, and External Heat Flux," PhD Dissertation, University of Michigan, 1968.

Since the trough cooling jacket is constructed as a weldment, it often is not designed or approved for use as a pressure vessel, allowing only very low coolant pressures and thus low flow rates imposing a substantial limitation on the rate of heat removal.

Similarly, conveying augers have also often been constructed as a weldment, with a central tube having radial spokes welded to a central tube forming a triangular cavity. Liquid coolant has sometimes been circulated through such an auger, with direct contact of the coolant with the metal auger which in turn is in direct contact with the hot material conveyed, leading to the same problems described above in connection with the conveyor trough.

Direct air cooling of the hot material requires dust collection equipment and baghouses and necessitates government permits, as pollutants may be mixed with the exhausted cooling air.

Many other industrial applications and high technology projects experience such difficulties, such as, screw conveyors in hot quick lime production, power plant hot clinker removal, hot surfaces of space vehicles during re-entry into the earth=s atmosphere, cooling high temperature engines and jets, boilers, etc.

It is an object of the present invention to provide arrangements and methods to control heat transfer into a liquid coolant within a flow vessel used to cool a hot material of the type described, in which direct contact of a liquid coolant with the structure holding the hot material is avoided.

It is a further object to provide a conveyor for hot material which avoids the use of weldments to mount parts subjected to thermal stresses induced by a large temperature differential between connected parts of the conveyor.

SUMMARY OF THE INVENTION

The above objects as well as other objects which will be understood upon a reading of the following specification and claims are achieved by a heat transfer arrangement including a connection between a coolant flow vessel and an inner wall structure to be cooled in which a desired controlled rate of heat transfer may be easily achieved to limit the rate of heat transfer to a predetermined level. This heat transfer arrangement connection may comprise a plurality of spaced apart stand off supports spacing the coolant vessel from the structure to be cooled. The stand off support crates a limited conductive heat transfer path between the structure to be cooled and the coolant vessel.

The stand offs may be comprised of an array of thin webs in contact with the inner wall and extending to the coolant vessel and outer wall.

As a preferred alternative, a mass of heat conductive beads of a predetermined size and configuration maybe confined in a space between the structure to be cooled and a coolant vessel as by an outer wall.

In one application of the invention, a conveyor including a trough along which hot material is conveyed, has separate liquid flow vessels passing over but spaced from an outside surface of the trough wall. The flow vessels are supported on the outer surface of the inner trough wall by heat conducting standoff supports such as interposed thin metal strips, angled metal strips or curved thin metal standoffs. A mass of conductive beads or particles may alternatively be provided, filling the space between the outer surface of the inner trough wall and the inner surface of an outer confining wall located beyond the coolant flow vessels.

Optionally, air flow can also be drawn in through openings in the outer wall and directed over the liquid flow vessels, and through the fins or beads to enhance cooling of the same.

The coolant liquid flow vessels can be arranged in longitudinal or transverse loops or longitudinally extending straight sections, and may supplied with a cooling liquid from a manifold at one end of the conveyor trough.

A helical auger tube mounted within the conveyor trough may have a side by side series of radially extending clamp-on wear plates of a durable material can be installed on the pushing side of the helical auger tube to prevent excessive wearing of the auger tube. The clamped attachment construction avoids thermally stressed welds. Optionally, a cooling fluid can also be circulated through the helical auger tube, or a second tube can be inserted in a larger outer helical tube with a series of metal strips or a mass of heat conductive beads, conducting the heat between the outer tube and the heat transfer liquid in the inner tube.

The arrangement of a mass of heat conductive beads, i.e., particles, in the space between a hot structure and a cooling structure provide a solution to excessive thermal stress and coolant boiling problems with minimum mechanical stiffness. In particular, the use of heat conductive particles interposed between the hot and cool surfaces such as a tube containing cooling water inside of a larger tube exposed to the high temperatures allows a precisely controlled rate of heat transfer therebetween. If the particles are spherical in shape, the mechanical stiffness of the medium is minimal and thermally induced stresses are avoided, furthermore, the contact area between the particles is also small to restrict the amount of heat being conducted through the mass of particles. If smaller size particles are used, the void ratio or open space is reduced which increases the contact area and the thermal conductance of the medium.

If the particle surfaces are flattened and made to fit adjoining particle surfaces, the contact area is farther increased and more heat is conducted. If the particles were shaped to be matched or complementary to each other perfectly with no void space, the medium is compact and approaches the heat transfer characteristic of a solid, except that the mechanical stiffness is still very small and the thermal stresses are minimized.

Use a material of a higher or lower thermal conductivity to construct the beads also allows a variation in overall thermal conductivity. Thus the thermal conductivity can be closely controlled to achieve a precisely predetermined heat transfer rate to suite a particular application.

DESCRIPTION OF THE DRAWINGS

FIG. 1.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figures 1, 8:
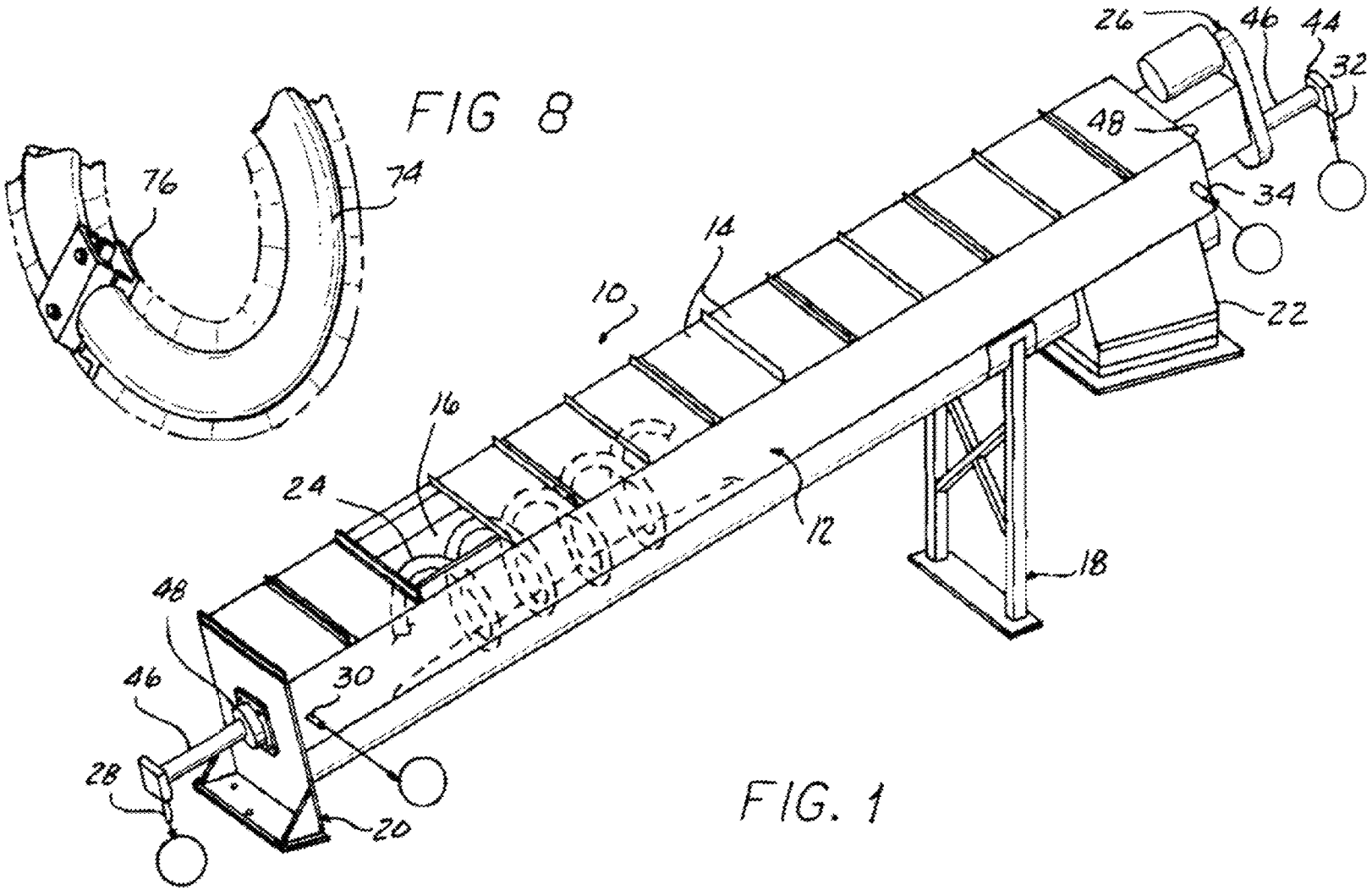
FIG. 1 is a perspective view of an auger conveyor according to the present invention showing a portion of a helical tube auger included in the conveyor in broken lines.
FIG. 8 is a fragmentary perspective view of the helical tube auger shown in FIG. 7 with a single wear plate shown in solid lines and a phantom line depiction of the entire series of wear plates.

Referring to the drawings and particularly FIG. 1, a conveyor 10 is shown which includes an inclined trough 12 provided with optional covers 14 installed along the top thereof except at a loading opening 16.

The trough 12 is supported to be upwardly inclined by means of frame supports 18, at either end.

A discharge chute 22 is at the upper end. A helically wound auger tube 24 is disposed lengthwise in the trough 14 and rotated by a rotary drive 26. A heat transfer liquid such as water used as a coolant is typically introduced at the discharge end through an axial inlet 32 and through a side inlet 34, and exits outlets 28, 30 at the lower end of the conveyor 10.

A source 34A, 32A of as a liquid coolant is respectively connected with each inlet 34, 32 and a coolant recycler (such as cooling towers) may be connected with each outlet 28, 30.

Figure 2:
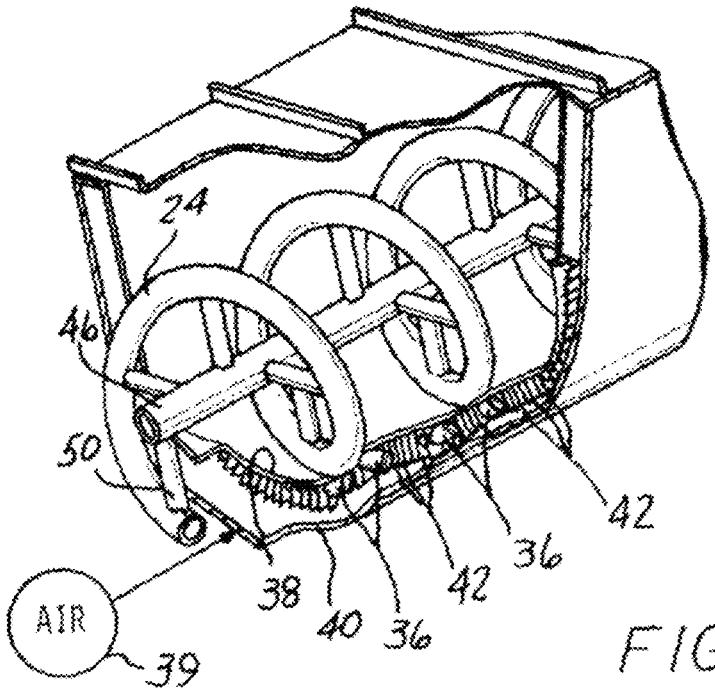
FIG. 2 is an enlarged partially broken away end view of the conveyor shown in FIG. 3 is an end view of the conveyor of FIG. 1, with the trough outer wall partially broken away and showing further details of a coolant flow tubing installation for the trough.

FIG. 2 shows further details. U-shaped loops of fluid flow tubing 36 are located between an inner trough wall 38 and an outer wall 40. The inner wall 38 typically would be made of heavy gauge metal to provide adequate structural support and durability as the conveyed material is in direct contact therewith and its weight supported thereby. The outer confining wall 40 can be of lighter gauge sheet metal or even a material having openings therein allowing air circulation through the intervening space such as the mesh material 40A indicated in FIG. 7.

The flow tube 36 is supported by interposed pieces here comprised of a series of side by side transverse thin metal fins or plates 42 contacting limited areas of the tubing 36 on edge, the outside surface of the inner wall 38 and the inner surface of the outer wall 40. Thus, liquid coolant does not directly contact the hottest structure, i.e., the inner wall 38, but rather there is only an indirect heat conducting path comprised of the interposed pieces, i.e. the fins or plates 42 contacting limited areas on the flow tubes 36.

The total area of contact and thus the conductivity of the pieces may be selected to allow conduction of heat into the liquid in the tubing 36 at a lower rate such as to 42 not result in boiling of the coolant liquid flowing within the tubing 36. The fins or plates 42 may extend between the inner wall longitudinally so that an air flow can optionally be blown through the space and over the fins or plates 42, from an air source 39.

Cooling liquid may also be circulated through the helical auger tube 24 introduced via a rotary fluid coupling 44 into a central support tube 46 rotated by the rotary drive 26 and supported by a rotary bearing 48 (FIG. 1).

Liquid is directed into the helical tube 24 via a radial support tube 50 mechanically attached to the support/drive tube 46. The support tube 46 is blocked so as to avoid circulation through the support tube 46 which would be overheated if the conveyed material was at a sufficiently high temperature, i.e., on the order of 1000° F. or higher. Outlet flow is directed out into a support tube 46 at the lower end of the conveyor.

Figure 3:
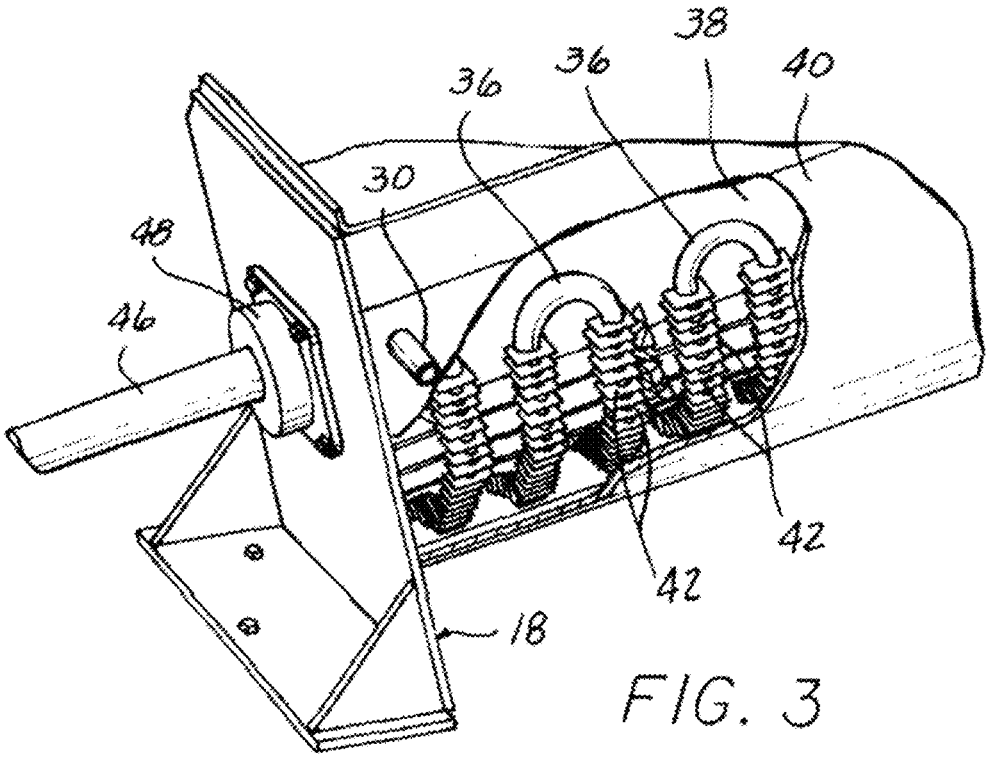

FIG. 3 shows another view of the trough coolant flow tubing 36 showing the U-shaped loops of tubing 36 and outlet 30, the loops extending transversely to the axis of rotation of the tube 24, i.e., in circumferential directions, although occupying only a portion of the perimeter of the trough 12.

Figure 4:
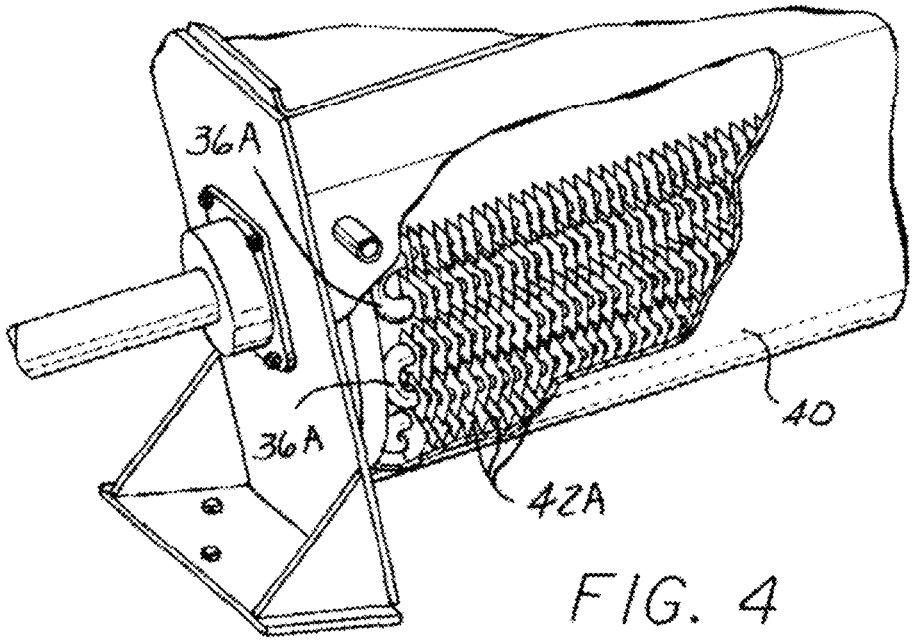
FIG. 4 is an end view of the conveyor with the outer wall broken away showing another form of coolant flow tubing installation for the trough.

FIG. 4 shows a variation in which coolant flow tube loops 36A are arranged longitudinally, and the fins or plates 42A are oriented transversely to the longitudinal axis of the conveyor 10.

Figures 5, 6:
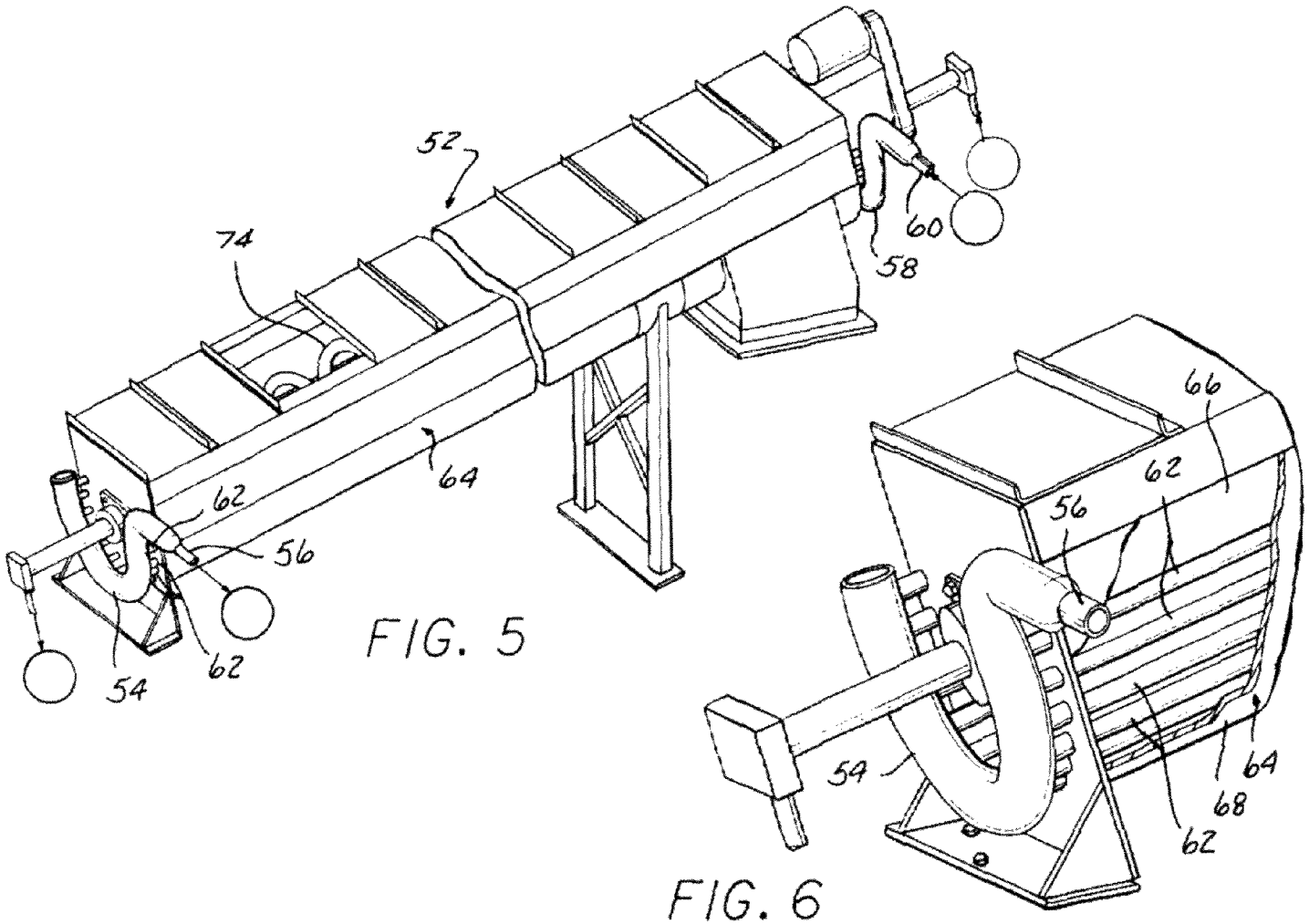
FIG. 5 is a perspective partially fragmentary view of another embodiment of the conveyor according to the present invention.
FIG. 6 is an enlarged fragmentary perspective view of one end of the conveyor shown in FIG. 5 with the outer wall of the trough partially broken away.

FIG. 5 shows another form of the conveyor 52 in which an inlet manifold 58 is connected to an inlet 60 at the upper end and an outlet manifold 54 is connected to an outlet 56. A series of straight longitudinal flow tubes 62 (best seen in FIG. 6) extend the length of the trough 64 in the space between an inner wall 66 and outer wall 68.

Figure 7:
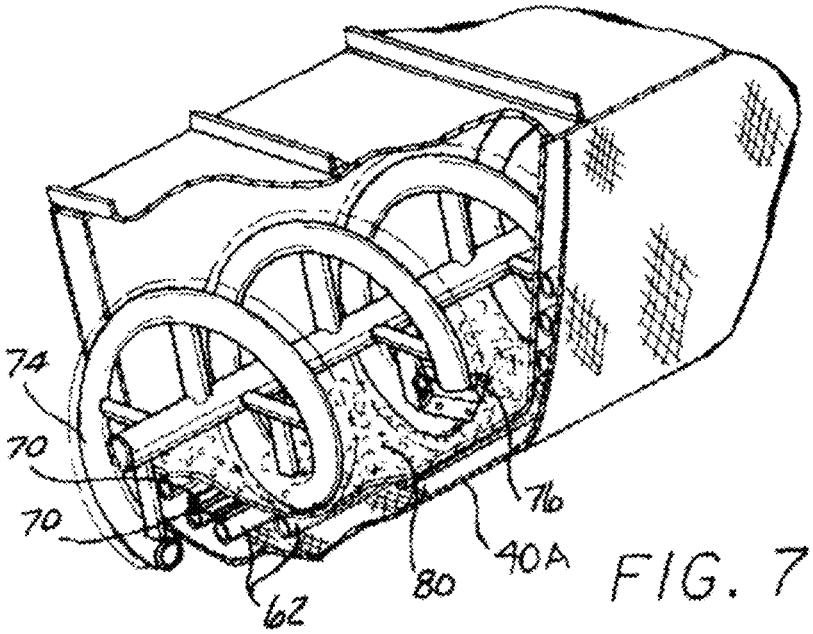
FIG. 7 is an enlarged perspective view of the end of the conveyor shown in FIG. 5 with both walls of the trough partially broken away to show the helical tube auger.
Figure 11:
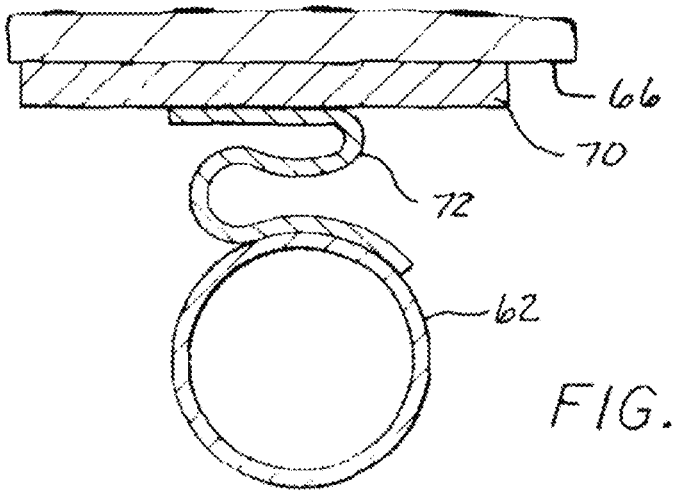
FIG. 11 is an enlarged transverse sectional view of a trough coolant tube of the type shown in FIG. 7.

As shown in FIG. 7, the tubes 62 are supported on the inner wall 66 by interposed pieces composed of thin metal straight strips 70 and curved thin metal bar stand offs 72 (FIG. 11).

Thus, the fluid does not directly contact the hottest structure, i.e., the trough inner wall 66, but rather has an interposed heat conductive connection thereto confined to a limited area of the tube 62 and wall 66. This reduces the rate of heat transfer to prevent a loss of conductivity which would result from a heat transfer rate causing boiling of the cooling liquid.

In order to reduce abrasion wear of the auger tube 74, a series of wear plates 76 are clamped on the pushing side of the auger tube 74, edge to edge along the length of the helical tube 74 (FIG. 8). This clamp-on construction is used instead of a welded conventional attachment to reduce thermal stress and avoid structional failures.

The hot granular material 80 being conveyed could otherwise rapidly wear the tube 74 depending on the material characteristics, temperature, as well as the volume conveyed.

Figure 9:
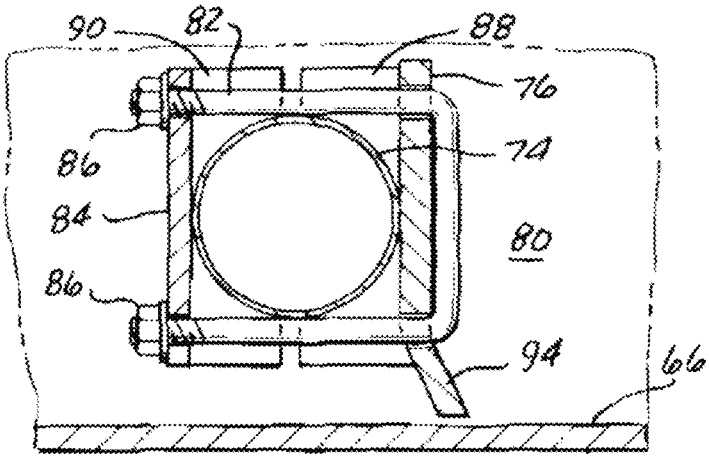
FIG. 9 is an enlarged transverse section taken across the helical tube auger and clamp on pusher blade of the type shown in FIG. 7.

FIG. 9 shows details of the attachment clamps for the wear plates 76 which are preferably constructed of a material such as an Nichrome alloy which is wear resistant at elevated temperatures.

A U-bolt 82 passes through a clamping piece 84 and is secured by nuts 86.

A pair of opposing legs 88, 90 on the wear plate 76 and clamping piece 84 have cut outs mating with the auger tube 74.

Figure 10:
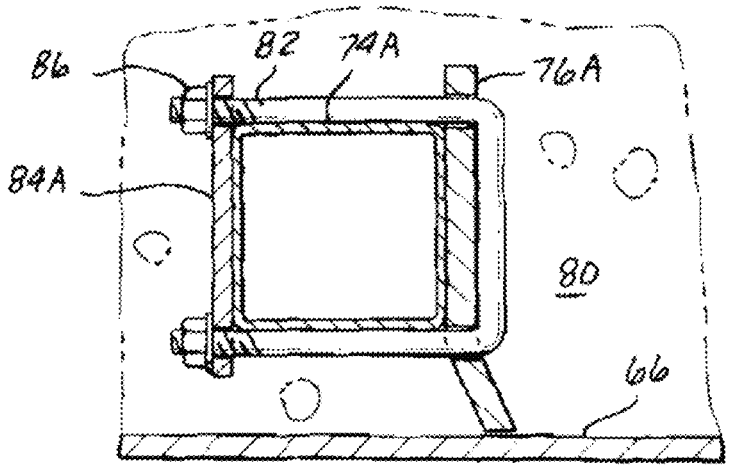
FIG. 10 is an enlarged transverse sectional view across a square section form of the helical tube auger.

FIG. 10 shows a square section tube 74A, such that a flat wear plate 76A and clamping piece 84A can be secured with the U-bolt 82A and nuts 86.

Both forms of wear plates 76 and 76A can have an angled portion 94 to assist in effectively pushing the material by rotation of the auger tube 74 or 74A. The clamp-on design avoids the problem of weld failure resulting from the high temperatures reached by the tube 74 when very hot material (1000 EF or higher) is conveyed.

Figure 12:
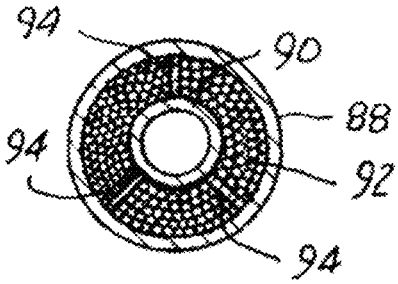
FIG. 12 is a sectional view of an inner round tube nested within a round outer tube using an interposed mass of beads as the heat transfer medium.

FIGS. 12-15 illustrate the use of an interposed mass of beads as a conductive connection having minimal mechanical rigidity while providing a controlled conductivity heat transfer path to a liquid coolant tubing so as to avoid boiling of the liquid by a too high rate of transfer of heat into the tubing. In FIG. 12, a round tube 88 as (used for auger tube 24) receives a smaller diameter inner coolant circulating tube 90. An intermediate space is filled with a mass of heat conducting beads or particles 92 to establish a heat transfer path which can be of a controlled conductivity by controlling the proportion of void space, in turn varying with the bead size. The type of bead material would be selected depending on the desired design parameters, but would typically be a durable thermally conductive material such as aluminum. The bead size would likewise be set to achieve the desired coefficient of thermal conductivity (see below).

A series of centering webs 94 should be provided to maintain the tubes centered with respect to each other while the space therebetween being loaded with the beads.

Figure 13:
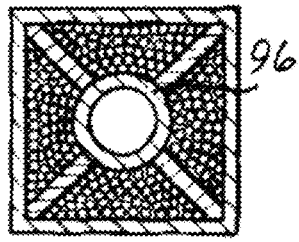
FIG. 13 shows an outer square tube having an inner tube carrying a heat transfer fluid, and with a mass of heat conductive beads interposed.

FIG. 13 allows a round inner tube 96 and square outer tube 98 and centering webs 100.

Figure 14:
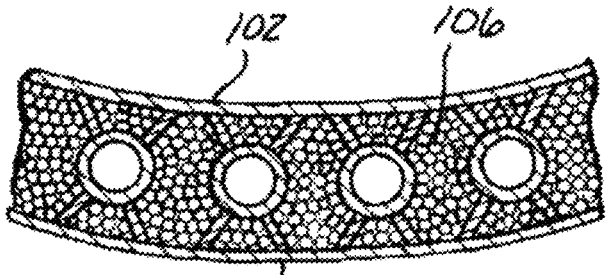
FIG. 14 shows a double walled conveyor trough having a mass of interposed beads as a heat transfer medium.

FIG. 14 shows a portion of a trough inner wall 102 and outer wall 104 with an intervening space filled with a mass of beads 106. Spacer webs 108 are also provided. This is intended to produce a precisely controlled designed for thermal conductivity selected so as to not cause boiling of the coolant and to thereby avoid the resultant loss of heat transfer into the coolant due to the presence of water vapor and boundary layer effects.

Figure 14A:
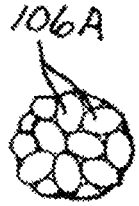
FIG. 14A is an enlarged view of the beads shown in FIG. 14, flattened to increase the contact area and thereby increase the thermal conductivity of the medium.

FIG. 14A shows flattened particles or beads 106A, which flattening reduces the void space and increases the contact area between the beads to increase the overall thermal conductivity of the medium.

Figure 15:
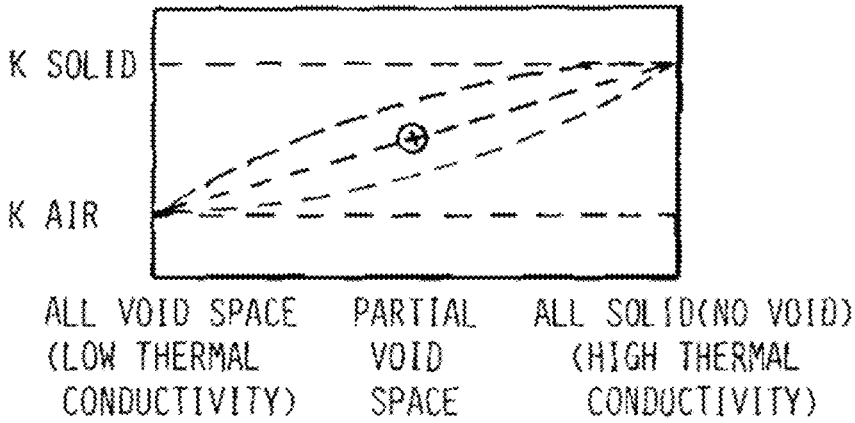
FIG. 15 is a diagram showing the relationship between thermal conductivity and the void space defined within a mass of heat conductive beads.

FIG. 15 shows the relationship between the proportion of void space and thermal conductivity.

Large diameter, spherical beads will conduct the heat while still allowing relative movement as induced by differing coefficients of thermal expansion of the adjacent structures without causing excessive stresses. Beads or particles of other regular shapes or irregular shapes could be selected that serve the same basic purpose of controlling thermal conductivity.

The proper selection of the spherically shaped particles involves diameter, material, and relative pipe sizes. If the space were filled with particles that would create a very large proportion of open spaces, this would approximate the conductivity of air filling the open spaces, and the thermal conductivity would therefore be very low. However, if the space were filled with very small particles with minimal void space, this would approach the thermal conductivity of a solid and the heat transfer rate would therefore be high, approaching that of the material of the beads. Somewhere between these two extremes is a void ratio that would be in line with the desired heat transfer characteristics. By properly selecting the particle sizes and material, and the overall geometry of the thermal screw, a design may be achieved which reduces thermal stresses to a level where structural problems are avoided, and sufficient material cooling is accomplished.

It should be noted that with proper design, forces due to dimensional changes from thermal effects, as well as thermal stresses cause by thermal gradients within structural members may be effectively controlled.

The invention claimed is:

1. A method of establishing a heat transfer path into a liquid coolant flow vessel separate from a heated hot structure to be cooled comprising interposing and packing together in contact a mass of heat conducting particles between said heated hot structure and said liquid coolant flow vessel, and sizing said particles to create sufficient open spaces between said particles to create an overall combined thermal conductivity of said packed together mass of particles and said open spaces such that the heat transfer rate into liquid coolant in said coolant vessel from said heated hot structure at the temperature of said heated structure is moderated to be below a level which would cause boiling of said liquid coolant flowing in said flow vessel.

2. The method according to claim 1 further including shaping said particles to be substantially spherical, said contacting particles defining the size of said open spaces.

3. The method according to claim 1 further including shaping said particles to be partially flattened and packed together to have flattened sides in contact with each other.

4. The method according to claim 1 wherein said particles comprise metal beads which are packed into a confining space containing said flow vessel.

5. The method according to claim 4 wherein said open spaces are filled with air such that said overall conductivity of said packed together particles and open spaces is defined in part by the thermal conductivity of air.

6. The method according to claim 1 wherein said open spaces are filled with air such that said overall conductivity of said packed together particles and open spaces is defined in part by the thermal conductivity of air.

7. The method according to claim 1 wherein said heated structure is formed in a trough shape to define a conveyor cavity receiving hot material at a temperature of about 1000° F. or greater which causes said structure to be heated by the presence of said hot material.

8. The method according to claim 1 wherein said mass of particles surrounds said liquid coolant flow vessel to provide a non rigid mechanical support of said flow vessel.

* * * * *